United States Patent [19]

Way

[11] Patent Number: 4,764,256

[45] **Date of Patent: * Aug. 16, 1988**

[54] REMOVAL OF POLYCHLORINATED BIPHENYLS BY SOLVENT EXTRACTION

[75] Inventor: Peter F. Way, Boxford, Mass.

[73] Assignee: Electric Power Research Institute, Inc., Palo Alto, Calif.

[ * ] Notice: The portion of the term of this patent subsequent to Oct. 16, 2001 has been disclaimed.

[21] Appl. No.: 133,263

[22] Filed: Dec. 16, 1987

Related U.S. Application Data

[63] Continuation of Ser. No. 20,237, Feb. 27, 1987, abandoned, which is a continuation of Ser. No. 559,191, Dec. 7, 1983, abandoned.

[51] Int. Cl.[4] ..... C10G 21/28; C10G 21/12

[52] U.S. Cl. ..... 203/46; 208/262; 208/317; 208/318; 208/321; 210/634

[58] Field of Search ..... 208/262, 311, 317, 318, 208/321; 203/43–46; 210/634, 765, 909

[56] References Cited

U.S. PATENT DOCUMENTS

| | | | |
|---|---|---|---|
| 2,111,360 | 3/1938 | Cutting | 208/312 |
| 2,201,549 | 5/1940 | Van Dijck | 208/317 |
| 3,544,453 | 12/1970 | Thompson | 208/321 |
| 3,825,489 | 7/1974 | Steinmetz et al. | 208/318 |
| 4,297,206 | 10/1981 | Scheibel | 208/318 |
| 4,299,704 | 11/1981 | Foss | 210/909 |
| 4,387,018 | 6/1983 | Cook et al. | 208/262 |
| 4,405,448 | 9/1983 | Googin et al. | 208/262 |
| 4,430,208 | 2/1984 | Pytleweski et al. | 208/262 |
| 4,477,354 | 10/1984 | Fessler | 210/636 |

FOREIGN PATENT DOCUMENTS 2071137 3/1980 United Kingdom .

OTHER PUBLICATIONS

Hutzinger et al., "The Chemistry of PCBs", CRC Press, Cleveland, Ohio, 1974, pp. 14–15.

Iaconiamni et al., "PCB Removal from Transformer Oil", EPRI PCB Seminar, Dec. 1981.

Rouse "Removal of PCB from Transformer Oil", Proceedings from EPRI PCB Seminar, Dec. 1981.

Napier et al., "Evaluation and Development of PCB Removal Processer", Oak Ridge, TN, Feb. 1982, pp. 6–10, 23, 29–32.

*Primary Examiner*—David L. Lacey

*Assistant Examiner*—K. M. Hastings

*Attorney, Agent, or Firm*—Flehr, Hohbach, Test, Albritton & Herbert

[57] ABSTRACT

A method is provided for continuous removal of polychlorinated biphenyl compounds (PCB) from oil contaminated therewith, comprising the steps of continuously extracting PCB compounds from contaminated oil with a PCB-selective solvent in the stripping section of a multistage extraction zone, partially distilling the extract from the extraction zone in a distillation zone, cooling and separating the bottom residue into a solvent phase and an oil/PCB phase, continuously recycling a major portion of the oil/PCB phase as extract reflux to the enriching section of the extraction zone where PCB compounds are extracted from the recycled portion by the solvent phase produced in the stripping section of the extraction zone to increase the PCB content of the extract, and withdrawing a minor portion of the oil/PCB phase from the separation step as a disposable PCB residue.

9 Claims, 1 Drawing Sheet

REMOVAL OF POLYCHLORINATED BIPHENYLS BY SOLVENT EXTRACTION

Figure 1:
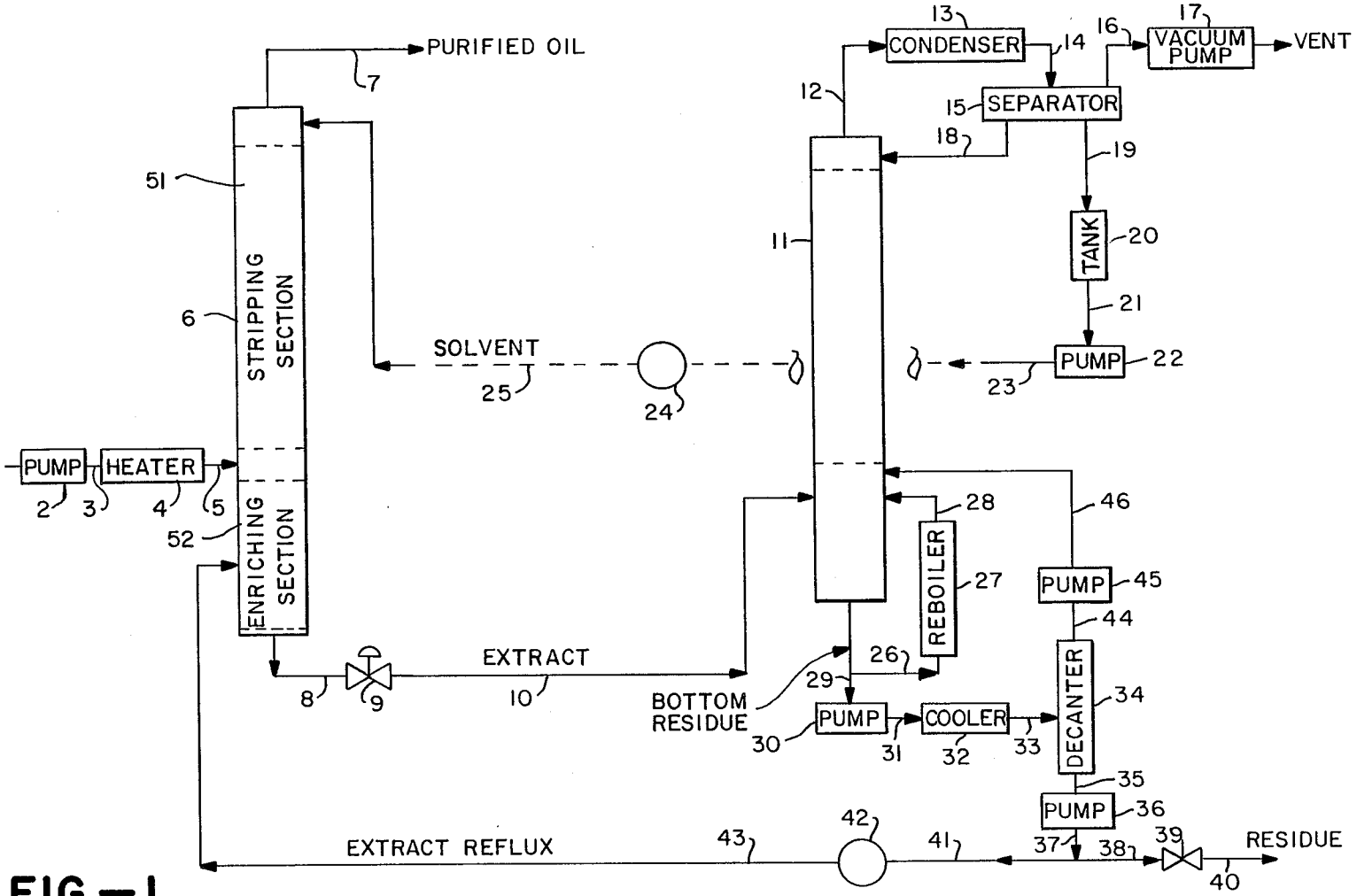

This is a continuation of application Ser. No. 020,237, filed Feb. 27, 1987, now abandoned, which is a continuation of application Ser. No. 559,191, filed Dec. 7, 1983 and now abandoned.

The present invention is directed to a method for continuously removing polychlorinated biphenyls (PCB) by solvent extraction from contaminated oil therewith.

The class of compounds known as polychlorinated biphenyls (PCB) has properties that make these compounds ideal for various applications in heat transfer systems and electrical equipment, such as transformers. However, it is suspected that PCB may cause health problems to the public at large, therefore the manufacture and use of PCB in commercial applications has been discontinued. Government regulations have been promulgated to control those materials currently in use and to control the level of exposure thereto to the general public.

One source of PCB is in oil used as heat transfer fluids in transformers, capacitors, and other electrical devices. Although various chemical and physical methods have been developed to treat PCB contaminated oils, it has been found that it is difficult to develop a process which will be effective in meeting the increasingly stringent government regulations pertaining to PCB concentration, yet will be economically feasible for industrial use.

Conventional methods of solvent extraction generally involve contacting a feed stream with a solvent in a countercurrent multistage extractor. In such an extractor, the concentration of the contaminant in the extract leaving the extractor is limited by the concentration of that material in the entering feed stream. Further, the portion of the feed that is soluble in the extract is ultimately removed from the process with the contaminant residue. In addition to the value of the lost feed substance, the overall operating cost of such a process is increased substantially by the increased cost of disposal for the larger residue stream and the increased energy cost for distillation.

Another difficulty encountered in removing contaminants from oils by conventional solvent extraction is the limitation imposed by the high boiling point of such oils and the degradation that occurs when they are processed at elevated temperatures, generally over about 150° C. In conventional solvent extraction, the solvent is separated from the oil fraction in the extract by distillation. The oil fraction being the less volatile material becomes the bottom residue in the distillation column. The energy requirements of the distillation are supplied by vaporizing a portion of the bottom residue, and thus if solvent removal from the oil fraction is essentially complete, as is conventionally the case, the temperature-pressure relationship is fixed solely by the volatility of the contaminant/oil fraction. The result may be either excessively high temperatures if moderate vacuum conditions are used, or extremely low vacuum if acceptable temperatures are used. Neither alternative is satisfactory, the excessive temperature causes degradation of the oil and the low vacuum is impractical from the standpoint of distillation equipment size and costs.

The present invention provides a method for removing PCB for PCB-contaminated oil without the complexity, expense, and oil loss characterizing known methods.

It is an object of the present invention to provide an improved method for removing PCB from contaminated oil.

It is another object of the present invention to provide a method for removing PCB in a continuous solvent extraction process utilizing a novel distillation process, whereby oil degradation during the distillation process is minimized.

It is a further object of the present invention to provide a method for removing PCB from oil contaminated therewith whereby oil loss is minimized and PCB concentration in the extract and therefore in the disposable PCB residue is increased.

The present invention provides a method for continuously removing PCB from oil contaminated therewith. According to the method of the present invention, PCB compounds are continuously extracted from contaminated oil with a PCB-selective solvent in the stripping section of a multiple stage extraction zone. The extract leaving the extraction zone is partially distilled in a distillation zone and the bottom residue therefrom is cooled and then separated into a solvent phase and an oil/PCB phase. The major portion of the oil/PCB phase, hereinafter referred to as the extract reflux, is continuously recycled to the enriching section of the extraction zone. In the enriching section, PCB compounds are extracted from the extract reflux by the solvent phase exiting the stripping section of the extraction zone to increase the PCB content of the extract and to return the oil in the reflux to the oil phase in the extraction zone. The minor portion of the oil/PCB phase is withdrawn as a disposable PCB residue.

The accompanying FIGURE illustrates a preferred embodiment of the means for accompanying the method of the present invention.

According to a preferred embodiment of the method of the present invention, PCB compounds are continuously extracted from contaminated oil with a PCB-selective solvent in a countercourrent, multistage extractor comprising two sections: (1) a stripping section in which the contaminated oil feed is extracted, and (2) an enriching section in which the extract reflux recycled from the solvent separation step is extracted. A stream of contaminated oil is continuously fed into the extractor where it enters the first stage of the stripping section. The PCB-selective solvent enters the last stage of the stripping section of the extractor, passes countercurrently to the contaminated oil from stage to stage, exits from the first stage of the stripping section, and flows to the last stage of the enriching section. The recycled extract reflux enters the first stage of the enriching section, and the solvent phase from the stripping section passes countercurrently to the extract reflux from stage to stage, and exits the extractor from the first stage of the enriching section as a PCB-enriched extract. The extract reflux exits the last stage of the enriching section, partially stripped of its PCB content, and joins the contaminated oil feed to enter the first stage of the stripping section. The combined oil stream, from which the PCB compounds have been extracted by the solvent, exists the last stage of the stripping section as the purified oil product.

The extract leaving the extractor is partially distilled in a distillation column and the bottom residue therefrom is cooled and then separated into a solvent phase, which is returned to the distillation column, and an oil/PCB phase. The major portion of the oil/PCB phase is continuously recycled back to the extractor as the extract reflux, and is extracted in the enriching section as described above. The minor portion of the oil/PCB phase from the solvent separating step is withdrawn as the disposable PCB residue.

The solvent chosen should be highly selective for PCB while at the same time having a low solubility for the oil and other constituents in the oil. The solvent itself should have a low solubility in oil. The solvent should have a volatility in a range that allows separation from a PCB/oil phase by distillation and a specific gravity sufficiently different from that of the oil to permit phase separation in the extraction stages. In addition, the solvent should have a reasonable viscosity and surface tension, as well as a low level of toxicity.

Suitable solvents for the extraction method of the present invention include those selected from the following solvent classes: alkyl substituted formamides and acetamides, pyrrolidones, sulfoxides, glycols, glycol ethers, aldehydes, and alcohols. Preferred solvents from these classes include N-methyl pyrrolidone, dimethyl sulfoxide, diethylene glycol monomethyl ether, commonly known as methyl Carbitol, and fufural. The most preferred solvent is diethylene glycol monomethyl ether.

Despite high selectivity for PCB, a solvent may still possess a measurable solubility for desirable oil constituents and thus in a conventional solvent extraction process, the oil loss could become excessive. For instance, if the solubility of oil in the solvent is about 10 percent and the solvent/oil ratio is about 1, the extract leaving a conventional extraction process would be carrying away about 10 percent of the oil feed. After distillation and separation of the solvent, the 10 percent of the original oil becomes the residue stream containing the extracted PCB. Thus, not only is 10 percent of the oil lost, but the PCB concentration has only been increased in the residue only a factor of 10. When the solvent/oil ratio is increased to achieve a higher PCB removal efficiency, the situation becomes worse. For instance, if the solvent/oil ratio is increased to 2, then the oil loss would increase to about 20 percent. In addition to the value of the lost oil, the overall operating cost is increased substantially by the increased cost of disposal for this large PCB residue stream.

According to the present invention, the oil loss due to solubility of the oil in the solvent is effectively eliminated by recycling a major portion of the oil/PCB phase from the solvent separation step back to the extractor, as an extract reflux. In this way, the oil carried out with the extract is returned to the enriching section of the extractor, and ultimately to the main oil stream entering the stripping section of the extractor and exiting as the purified oil product. The PCB in the recycled portion is transferred to the outflowing extract, thereby markedly increasing its PCB concentration. In the method of the present invention, increasing the solvent/oil ratio does not increase the oil loss or reduce the PCB concentration in the residue, as would be the case in a conventional solvent extraction process.

According to the present invention, the solvent separation from the extract is carried out in two steps. First, there is a partial separation by distillation and then, a final purification by phase separation made possible by lowering the temperature of the bottom residue from the distillation step. In a preferred embodiment of the present invention, the partial separation by distillation is accomplished by maintaining sufficient solvent in the bottom residue to permit operating the column under economical vacuum conditions and acceptable temperatures. In order to achieve such conditions, there should be about 20 to 80 percent solvent in the bottom residue. The distillate product from this step comprising PCB-free solvent is recycled back to the extractor.

In the second separation step, the bottom residue is cooled to a temperature below the limits of mutual solubility to form a PCB/oil phase and a solvent phase. The two phases are separated by decanting, and the solvent phase is returned to the distillation column. The PCB/oil phase, for the most part, is recycled back to the extractor as extract reflux. A small portion of the PCB/oil phase is withdrawn as the final PCB residue.

Referring to the FIGURE, a flow chart illustrates a preferred embodiment of the means for accomplishing the method of the present invention. A stream of oil contaminated with PCB is introduced into the extractor 6 at a controlled rate through lines 1, 3 and 5, using pump 2 and heater 4 to raise the temperature of the oil to between about 20° and 65° C. The oil stream enters extractor 6 at an intermediate feed point. The extractor consists of two sections, a stripping section 51 and an enriching section 52. In the stripping section, the oil contacts the solvent in a process of countercurrent mixing and coalescing whereby the PCB compounds are continuously extracted from the oil in multiple stages and the purified oil exits the extractor 6 through line 7.

After washing with water to remove the small amount of solvent present, then drying and filtering, (equipment not shown) the purified oil product is suitable for reuse as a dielectric fluid. The number of theoretical stages in the stripping section required to achieve a PCB removal efficiency in the range of 90 to 98 percent is about 3 to 10, preferably 6, when employing a solvent/oil ratio in the range of about 1:1 to 4:1. The desired solvent/oil ratio is determined by the type of PCB compound being extracted and the PCB concentration in the contaminated oil.

The solvent phase flows from the first stage of the stripping section 51 through the enriching section 52 in countercurrent flow with the recycled extract reflux entering by line 43, and leaves the extractor 6 through line 8 and control valve 9, flowing through line 10 as the extract feed to the distillation column 11.

Distillation is carried out in the range of about 50 to 150 torr, perferably about 100 torr. The vapor flow rate through the distillation column 11 is maintained by adjusting the heat input to reboiler 27. Purified solvent vapor exiting the top of the distillation column by line 12 is condensed in condenser 13 and flows to separator 15 through line 14. Noncondensable gases are removed through line 16 by means of a vacuum pump 17. A portion of the condensed solvent is returned to the distillation column as reflux by line 18, while the other solvent portion flows through line 19 to tank 20, and is recycled as PCB-free solvent back to the extractor 6 by line 21, pump 22, line 23, flow controller 24, and line 25.

The bottom residue from the distillation column 11 exits the column by line 29 and is pumped by pump 30 through line 31 to cooler 32. In cooler 32, the bottom residue is cooled to a temperature in the range of about 25°-50° C. and a PCB/oil phase and solvent phase are formed. The two phases flow through line 33 to decanter 34 where they are separated. The solvent phase is returned to the distillation column 11 by lines 44 and 46, and pump 45. The PCB/oil phase which is removed from the decanter by lines 35 and 37, and pump 36, is divided into a major portion, the extract reflux, and a minor portion, the disposable PCB residue. The residue portion exits the process through lines 38 and 40, and control valve 39. The larger reflux portion is continuously recycled to the extractor 6 by lines 41 and 43, and flow control valve 42, and enters the enriching section 52 of the extractor 6.

In the enriching section of the extractor, the extract reflux is contacted with the solvent phase flowing from the first stage of the stripping section 51 in a similar process of countercurrent mixing and coalescing stages to increase the PCB content of the extract. The number of theoretical stages in this seciton is in the range of about 1 to 6, preferably 3, depending upon the desired concentration of PCB in the final residue exiting the process. Leaving the enriching section by line 8 and control valve 9, the extract flows by line 10 to the distillation column 11 where it is distilled, then separated and recycled as described above.

EXAMPLE 1

In an agitated baffled extraction column with a diameter of 150 mm, an extraction section height of about 1000 mm, and an enriching section height of about 500 mm, operating at 38° C. with a transformer oil feed rate of 25 liters/hour, an extractor reflux rate of 1.6 liters/-hour, and using diethylene glycol monomelthyl ether as the solvent at a rate of 59 liters/hours, the PCB (a blend of polychlorinated biphenyls with a chlorine content of 54 weight percent, commonly known as Aroclor 1254) content of 389 ppm in the transformer oil was reduced to 8 ppm in the purified oil existing the extractor. The distillation column with a diameter of 150 mm and a packed height of about 1800 mm, which was operated in conjunction with the extraction column in a continuous process, effected a separation of the solvent from the extract steam to a solvent purity of less than 1 ppm PCB. The residue produced by cooling the distillation column bottom product and separating the PCB/oil phase from the solvent phase, was accumulated at a rate of 0.56 liters/hour and had a PCB concentration of 1.7 percent.

EXAMPLE 2

In the same equipment and using the same solvent and PCB type as described in Example 1, but with an oil feed rate of 39 liters/hour, an extractor reflux rate of 7.6 liters/hours, and a solvent rate of 73 liters/hour, the PCB content of the 521 ppm in the contaminated oil was reduced to 31 ppm in the purified oil. The distilled solvent had a PCB content of less than 1 ppm. The residue product accumulated at a rate of 0.33 liters/-hour, and had PCB content of 5.8 percent.

EXAMPLE 3

In the same equipment and using the same solvent and PCB type as described in Example 1, but with an oil feed rate of 16 liters/hours, an extractor reflux rate of 8.7 liters/hour, and a solvent rate of 73 liters/hour, the PCB content of 500 ppm in the contaminated oil was reduced ot about 1–2 ppm in the purified oil. The residue product accumulated at a rate of 0.17 liters/hour and had a PCB content of 4.8 percent.

EXAMPLE 4

In the same equipment and using the same solvent as described in Example 1, but with an oil feed rate of 16 liters/hour, an extractor reflux rate 7.4 liters/hours, and a solvent rate of 73 liters/hour, the PCB (a blend of polychlorinated byphenyls with a chlorine content of 60 weight percent, commonly known as Aroclor 1260) content of 443 ppm in the contaminated oil was reduced to 11 ppm in the purified oil. The PCB content of the solvent from the distillation column was less than 1 ppm. The residue product accumulated at a rate of 0.15 liters/hours and had a PCB content of 4.6 percent.

Many modifications and variations of the present invention are readily obvious to those of ordinary skill in the art in light of the above specifications and it is understood that such modifications and variations are within the scope of the present invention.

What is claimed is:

1. A method for continuously removing polychlorinated biphenyl compounds from oil contaminated therewith, comprising the steps of:

(a) in a multiple stage extraction zone having a stripping section and an enriching section, continuously extracting polychlorinated biphenyl compounds from contaminated oil fed into said stripping section with a solvent selective for polychlorinated biphenyl compounds;

(b) partially separating said solvent from extract produced in said extraction zone by partially distilling said extract in a distillation zone to produce residue containing about 20 to 80% of said solvent;

(c) separating said solvent from said bottom residue by cooling said bottom residue to produce a solvent phase and an oil/polychlorinated biphenyl phase and then separating said solvent phase from said oil/polychlorinated biphenyl phase;

(d) continuously recycling a major portion of said oil/polychlorinated biphenyl phase from step (c) to said enriching section of said extraction zone to extract polychlorinated biphenyl compounds from said recycled portion with solvent exiting said stripping section of said extraction zone to increase the polychlorinated biphenyl content of said extract exiting said extraction zone and to minimize oil loss;

(e) withdrawing a minor portion of said oil/polychlorinated biphenyl phase from step (c) as a disposable polychlorinated biphenyl residue;

(f) recycling said separated solvent phase from step (c) to said distillation zone of step (b); and (g) recycling said separated solvent phase from step (b) to said extraction zone of step (a).

2. A method according to claim 1, wherein said distillation step (b) is carried out at a pressure of about 50 to 150 torr and a temperature not exceeding about 150° C.

3. A method according to claim 1, wherein said solvent is selected from the group consisting of alkyl substituted formamides and acetamides, pyrrolidones, sulfoxides, glycols, glycol ethers, aldehydes, and alcohols.

4. A method according to claim 3, wherein said solvent is selected from the group consisting of N-methyl pyrrolidone, dimethyl sulfoxide, diethylene glycol monomethyl ether, and fufural.

5. A method according to claim 4, wherein said solvent in diethylene glycol monomethyl ether.

6. A method according to claim 1, wherein said extraction step (a) removes about 90 to 98 percent of the polychlorinated biphenyl compounds from the contaminated oil in about three to ten theoretical extraction stages and the solvent/oil feed ratio is in the range of about 1:1 to 4:1.

7. A method according to claim 6, wherein said extraction step (a) is carried out in about six theoretical extraction stages.

8. A method according to claim 1, wherein said extraction of said polychlorinated biphenyl compounds from said recycled portion in step (d) is carried out in about one ot six theoretical extraction stages.

9. A method according to claim 8, wherein said extraction of said polychlorinated biphenyl compounds from said recycled portion in step (d) is carried out in about three theoretical extraction stages.

* * * * *